United States Patent [19]

Coudert et al.

[11] Patent Number: 4,739,136

[45] Date of Patent: Apr. 19, 1988

[54] CONTROL DEVICE OF A HIGH VOLTAGE CIRCUIT BREAKER EQUIPPED WITH CLOSING RESISTORS

[75] Inventors: Patrick Coudert, Eybens; Alain DeLahousse, Meylan; Jean-Paul Ravet, Grenoble, all of France

[73] Assignee: Merlin Gerin, Grenoble Cedex, France

[21] Appl. No.: 932,321

[22] Filed: Nov. 19, 1986

[30] Foreign Application Priority Data

Nov. 27, 1985 [FR] France ..... 85 17644

[51] Int. Cl.[4] ..... H01H 33/04

[52] U.S. Cl. ..... 200/144 AP; 200/148 D

[58] Field of Search ..... 200/144 AP

[56] References Cited

U.S. PATENT DOCUMENTS 1,881,466 10/1932 Gano ..... 200/67 R

FOREIGN PATENT DOCUMENTS 0021904 7/1981 European Pat. Off. ..... 200/144 AP 3132821 11/1982 Fed. Rep. of Germany ..... 200/144 AP 287686 4/1953 France .

2493034 4/1982 France .

*Primary Examiner*—Robert S. Macon

*Attorney, Agent, or Firm*—Parkhurst & Oliff

[57] ABSTRACT

A high voltage self-blowing circuit breaker with closing resistors is equipped with an auxiliary contact inserted in the trip control circuit of an electrical circuit breaker. The auxiliary contact is actuated by the mechanical control rod of the circuit breaker, in such a way as to prevent any operator closing error. A high-speed mechanism is inserted in the link system connecting the control rod and the auxiliary contact, with a dead travel mechanism to delay closing of the auxiliary contact when a closing operation takes place and to prevent a tripping order, liable to cause a flashover on the inserter contacts and damage to the circuit breaker, from being transmitted too early.

6 Claims, 6 Drawing Sheets

32
34
38
40°
40
30
46
48
20°
35°

CONTROL DEVICE OF A HIGH VOLTAGE CIRCUIT BREAKER EQUIPPED WITH CLOSING RESISTORS

BACKGROUND OF THE INVENTION

The invention relates to a control device of a high voltage electrical circuit breaker having one (or more) arc chute with main contacts shunted by one (or more) parallel circuit with closing resistors connected in series with inserter contacts, comprising an articulated rod mechanism connecting the main and inserter contacts to close the inserter contacts electrically just before electrical closing of the main contacts and to reopen the inserter contacts after closing of the main contacts. A sliding control rod linking said articulated rod mechanism to a hydraulic, mechanical or air-operated control unit, one (or more) auxiliary electrical contact mechanically actuated by the rod or the control unit to represent respectively the opening and closing positions of the main contacts and an electrical transmission circuit of a circuit breaker opening order to said control unit, in which electrical circuit said auxiliary contact is inserted in such a way as to transmit the opening order only in the closing position of the main contacts.

A control device of the kind mentioned receives closing and tripping orders in electrical form, these electrical orders being transformed into hydraulic orders executed by a jack actuating a sliding rod controlling closing and opening of the circuit breaker contacts. The electrical control circuit comprises safety features preventing any operator error, notably an auxiliary contact accurately representing the circuit breaker closed position. The operations are extremely high-speed, requiring a few tens of milliseconds only, and it is indispensable that perfect synchronization be ensured in order to avoid damaging a circuit breaker. More particularly in the case of the circuit breaker closing on a fault the circuit breaker must open quickly, the operation sequence nonetheless being respected. When a closing operation takes place, the inserter contacts close first to insert the resistors in the circuit and limit the voltage surges on closing of the main contacts which takes place just after closing of the inserter contacts. The inserter contacts are subsequently re-opened so as to set the circuit breaker to a position ready for tripping. The auxiliary contact, inserted in the electrical control circuit, notably prevents an electrical tripping order being transmitted before the inserter contacts have opened. It is clear that opening of the main contacts before opening of the inserter contacts would cause an arc on the latter contacts bringing about damage to the circuit breaker. State-of-the-art control devices comprise hydraulically-controlled auxiliary contacts and synchronization and time delay can be ensured with sufficient accuracy for the circuit breaker to operate satisfactorily. These hydraulic controls are however costly and complicated, and the object of the present invention is to provide a simplification and a considerable reduction in the production costs of these auxiliary contact control devices, and in addition to reduce the dimensions and complexity of the installation.

SUMMARY OF THE INVENTION

The control device according to the invention is characterized by the fact that said auxiliary contact comprises a high-speed operating mechanism having a dead travel mechanism which delays, and then ensures auxiliary contact closing at a precise moment preventing any flashover in the inserter contacts when the main contacts open instantaneously after their closing.

The auxiliary contact control performed by an adjoining hydraulic jack is replaced by a mechanical operating device secured to the movement of the circuit breaker control rod, actuated by the control unit. By using a high-speed mechanism, inaccuracies as to the position of the auxiliary contact are avoided ensuring almost instantaneous closing of the contact for a preset control rod position. The dead travel provides a time delay sufficient for the inserter contacts to open before the main contacts open.

The auxiliary contact is advantageously a contact bridge rotating through 90°, and the dead travel results from an engagement with clearance of an off-center finger supported by a plate driven in a circular aperture arranged in a coaxial drive plate and located facing the first plate. The length of the circular aperture defines the drive dead travel between the movable contact bridge and the control by the sliding rod. The high-speed operating mechanism can be achieved by a spring acting on the finger supported by the driven plate with a dead point passage defining the high-speed movement of the auxiliary contact.

BRIEF DESCRIPTION OF THE DRAWINGS

Other advantages and characteristics will become more clearly apparent from the following description of an embodiment of the invention, given as an example only, and represented in the accompanying drawings, in which.

DESCRIPTION OF THE PREFERRED EMBODIMENT

Figure 1:
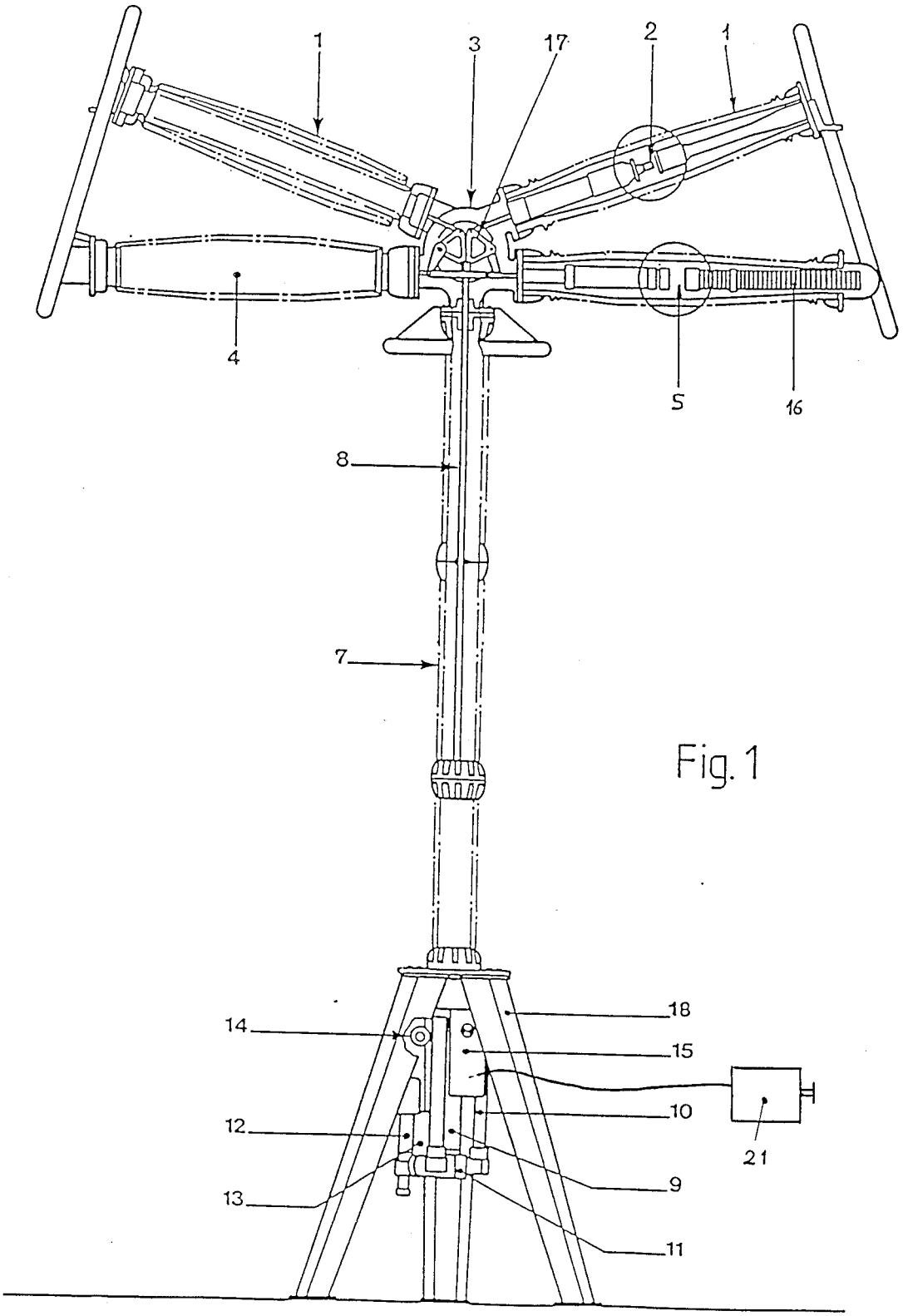
FIG. 1 is a schematic elevational view of a circuit breaker equipped with a control device according to the invention.

In the figures, a pair of arc chutes 1 of a high voltage self-blowing circuit breaker are supported by a housing 3 and are electrically connected in series. Main contacts 2 and an arc blowing device of the piston-and-cylinder type are located inside each arc chute 1. The housing 3 is supported by an insulator pillar 7 inside which a control rod 8 made of insulating material extends. Each arc chute 1 has associated with it a shunting chamber 4 supported by the housing 3. Each shunting chamber 4 comprises in series resistors 16 and inserter contacts 5, which shunt the contacts 2 of the arc chutes 1 in the closed position of the inserter contacts 5. A rocker and articulated rod mechanism 17 housed inside the housing 3 connects the moving contacts of the main 2 and inserter contacts 5 to the control rod 8 to control opening and closing of these contacts in a predetermined order. A control mechanism of this kind can be of the type described in U.S. Pat. No. 3,763,340 which should be referred to for further details. This mechanism is arranged in such a way as to first close the inserter contacts 5, when a closing operation takes place corresponding to an upward sliding of the control rod 8. Further sliding of this rod 8 causes closing of the main contacts 2 followed by re-opening of the inserter contacts 5. It is clear that the main contacts 2 can be associated with arcing contacts in a manner well known in the art to avoid an arc forming on the contacts ensuring conduction of the rated current. A tripod 18 placed on the ground supports the base of the pillar 7 and also a hydraulic control unit 14 comprising a jack 9 coupled to the rod 8. The control unit 14 comprises the other standard elements, in this case a hydraulic accumulator 10, a hydraulic relay 11, an operational unit 12, an auxiliary feed-tank 13 and auxiliary contacts 15. The operational unit 12 receives the circuit breaker closing and tripping orders from an electrical control circuit 21 and transforms these electrical orders into a hydraulic feed or discharge order of the jack 9. The auxiliary contact 15 is inserted in the electrical control circuit to transmit or inhibit an electrical order depending on whether the auxiliary contact 15 is in the closed or the open position.

Figure 2:
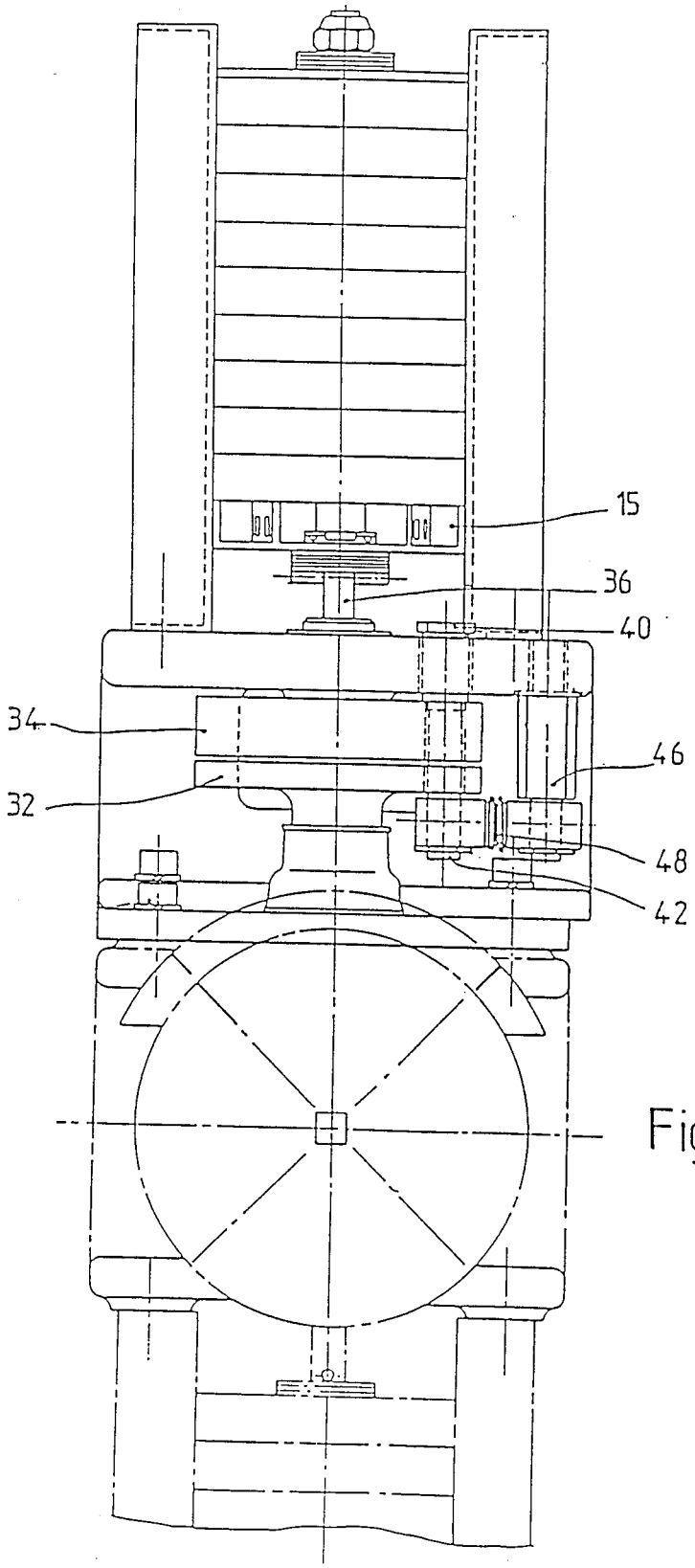
FIG. 2 is a partial view, on a reduced scale, of the auxiliary contact control mechanism, according to FIG. 1.
Figure 3:
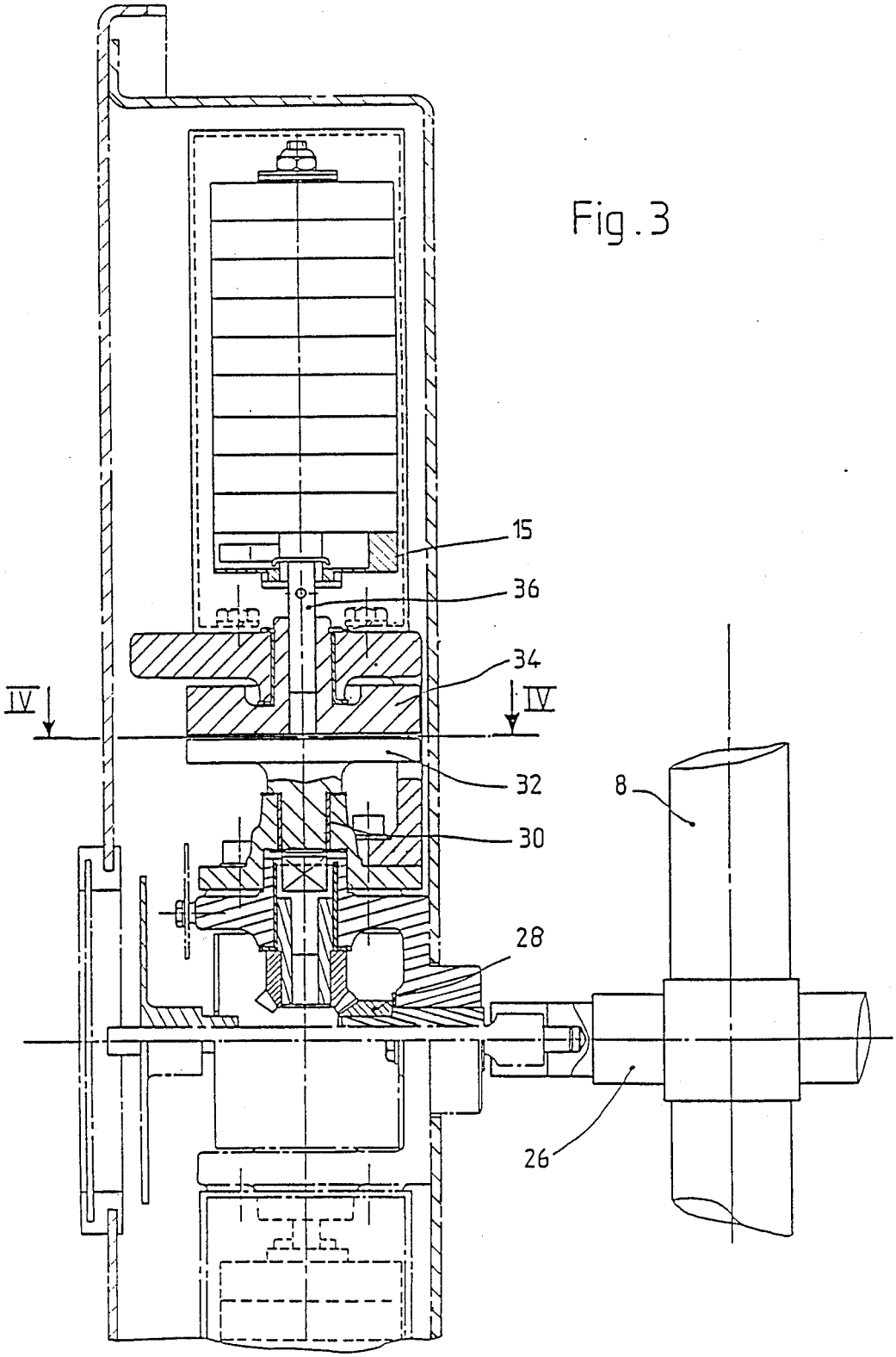
FIG. 3 is a side view of the mechanism according to FIG. 2.
Figure 4:
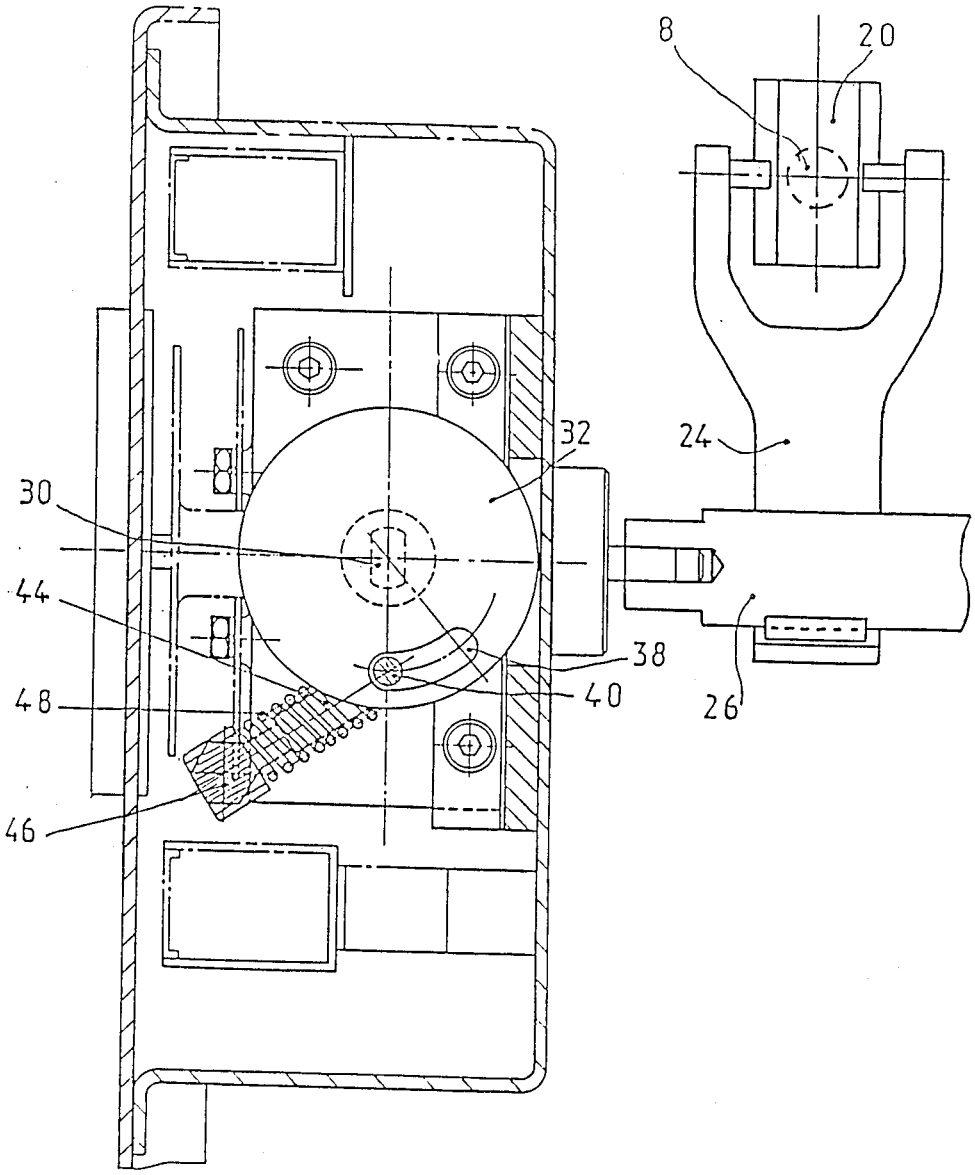
FIG. 4 is a sectional view along the line IV—IV of FIG. 3.
Figures 5, 6, 7, 8:
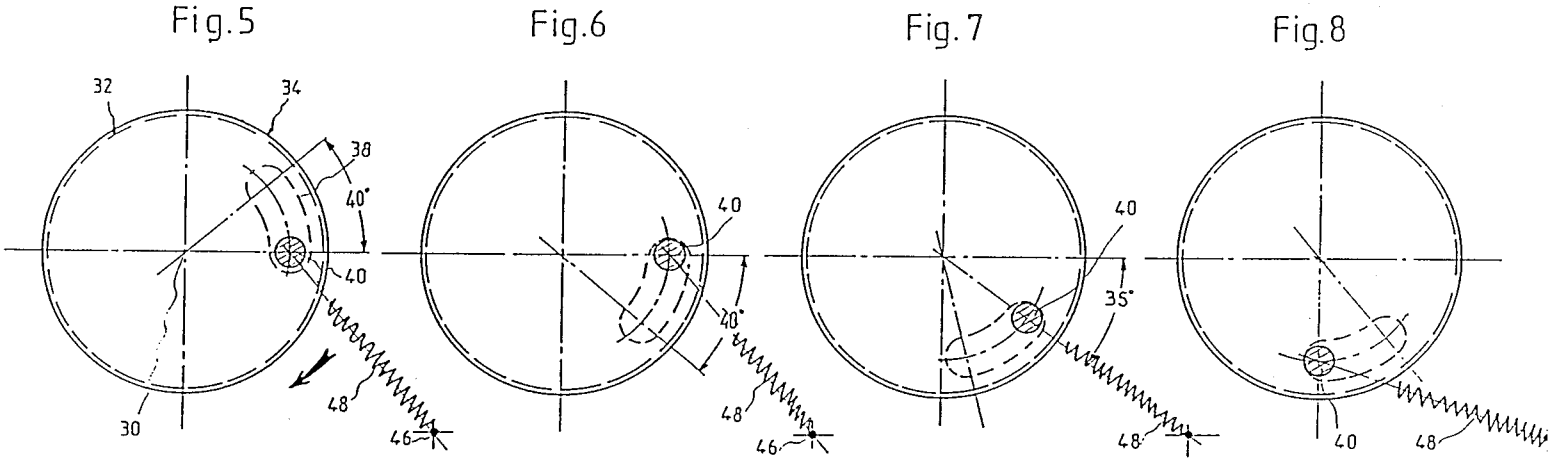
FIGS. 5 to 8 represent the different positions of the drive plate and driven plate of the auxiliary contact control mechanism, according to FIG. 4.

Referring more particularly now to FIGS. 2 to 4, it can be seen that the control rod 8 bears a slide 20 with which the forked end of a crank-handle 24 keyed on to a shaft 26 cooperates. A bevel wheel transmission 28 connects the shaft 26 to a shaft 30 supporting a drive plate 32 disposed facing a coaxial driven plate 34. The driven plate 34 is keyed onto the end of a control shaft 36 of an auxiliary contact block 15, only one of which is involved in the present invention, the others being used for additional safety or locking functions. The auxiliary contact 15 has a contact bridge supported by the shaft 36 and cooperating with a pair of stationary contacts arranged opposite one another. An alternative 90° rotation of the shaft 36 causes opening and closing of the auxiliary contact 15. The drive plate 32 has a circular aperture 38 of a length close to 40° in which a finger 40 securedly attached to the driven plate 34 is engaged. The aperture 38 - finger 40 assembly constitutes a dead travel connection or mechanism between the plates 32, 34. A telescopic rod 44 is articulated on the external part 42 of the finger 40, the opposite end of this rod 44 being articulated on a fixed pivot 46. A compression spring 48 is fitted on the telescopic rod 44 biasing the rod 44 to the extension position. The telescopic rod 44 and the spring 48 constitute a high-speed mechanism with a dead point corresponding to the alignment of the axes 30, 46 and of the finger 40. In the circuit breaker open position, represented in FIGS. 1 to 5, the spring 48 is expanded, the finger 40 being at the end of the aperture 38. A closing order, corresponding to an upward sliding of the control rod 8, causes rotation of the shaft and the corresponding clockwise rotation of the drive plate 32 as indicated by the arrow in FIGS. 4 and 5. This rotation of the drive plate 32 is not transmitted to the driven plate 34 due to the aperture 38 allowing rotation until the finger 40 comes up against the end of the aperture 38, the position represented in FIG. 6. When continued rotation of the drive plate 32 occurs, the finger 40 and the driven plate 34 move to the dead point position represented in FIG. 7. As soon as the dead point is passed, the spring 48 compressed by this first rotation phase expands moving the finger 40 sharply to the position represented in FIG. 8 driving the plate 34 fixedly secured to the auxiliary contact 15. It can easily be seen that the system made up of the plates 32, 34 and aperture 38 performs high-speed actuation of the auxiliary contact 15 associated with a dead travel mechanism delaying closing of the auxiliary contact 15. The driven plate 34 effects a 90° movement causing closing of the auxiliary contact 15, the time delay introduced by the dead travel mechanism 38 being 10 to 30 milliseconds. In the opposite way, a tripping order causes opening of the auxiliary contact 15, the driven plate 34 being fixedly secured in rotation to the drive plate 32 as soon as it begins rotating without any time delay.

Figure 9:
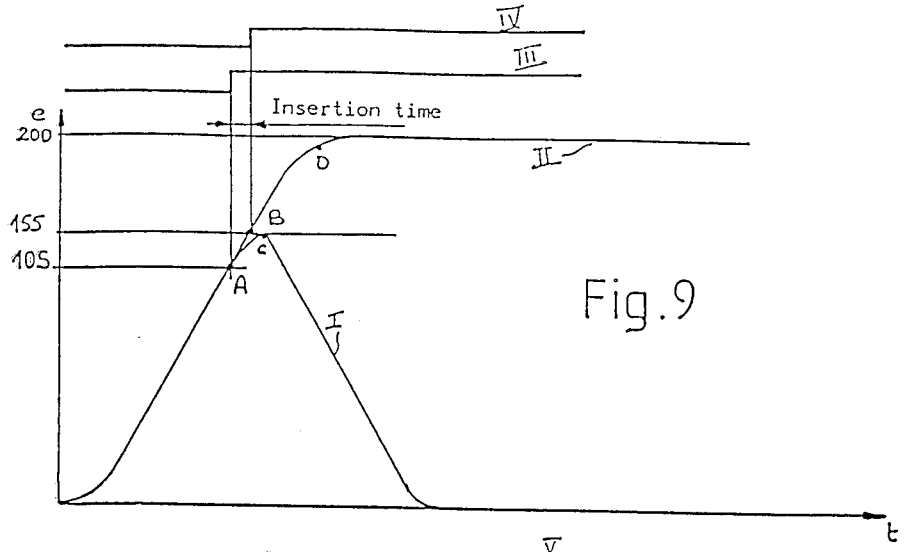
FIG. 9 shows the closing curves of a standard circuit breaker.
Figure 10:
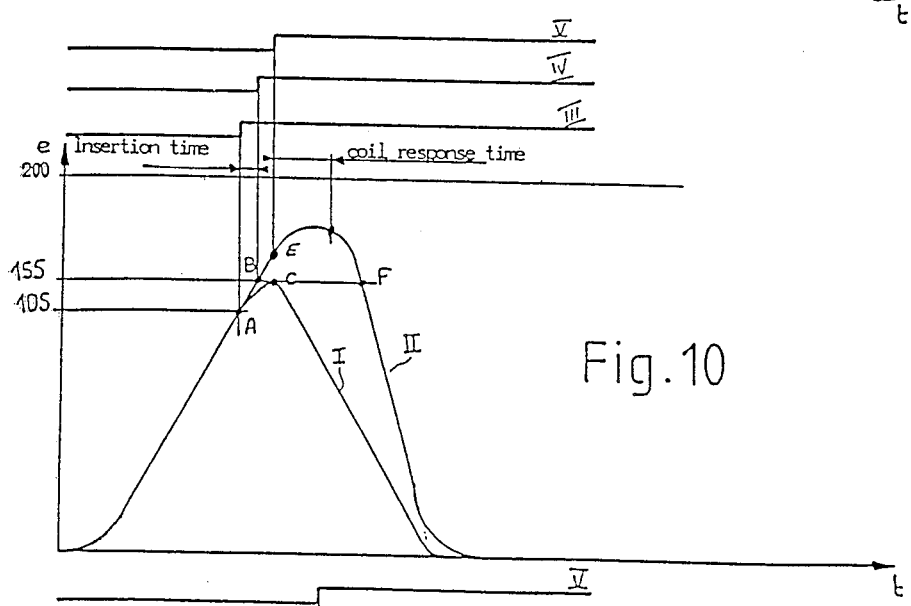
FIG. 10 is a similar view to that of FIG. 9, showing the closing cycle of a standard circuit breaker with risk of flash-over on the inserter contacts when immediate re-opening occurs.
Figure 11:
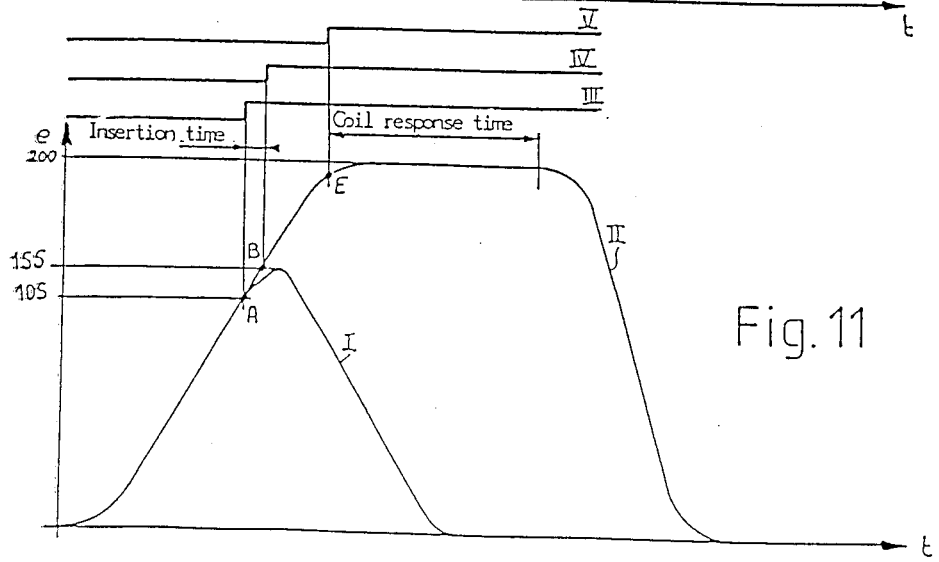
FIG. 11 is a similar view to that of FIG. 10, illustrating the closing curves of a circuit breaker according to the invention.

Operation of the control device according to the invention is described hereafter referring to FIGS. 9 to 11:

Curve I represents the travel of the movable inserter contact 5 in terms of the time t of a standard circuit breaker when a closing operation takes place. Curve II represents the corresponding travel of the main movable contact 2, whereas curves III and IV represent the electrical closing and opening positions respectively of the inserter contact 5 and of the main contact 2. Electrical closing of a contact corresponds to the moment the current is established, this closing being distinct from mechanical closing which corresponds to the final engagement position of the contacts. Similarly, electrical opening corresponds to interruption of the current, which precedes full mechanical opening of the contacts. In FIG. 9, it can be seen that in a first stage the inserter and main contacts move simultaneously to the point A corresponding to electrical closing of the inserter contact 5. The closing resistor 16 is thus connected in the circuit, electrical closing of the main contact 2 occurring a short time after at the point B. The insertion time of the resistor 16, represented by curve IV, corresponds to the time interval between the points A and B. The movable inserter contact 5 then moves to the mechanical closing position at the point C and immediately engages its opening travel in the opposite direction. The main contact 2 moves to the mechanical closing position at the point D.

FIG. 10 represents operation when closing occurs on a fault, a tripping operation taking place immediately after the closing operation. Curve I, corresponding to the inserter, is identical to the one described in FIG. 9, whereas curve II shows that the main contact 2 closes electrically at the point B, but never reaches the full mechanical closing position. The tripping order is transmitted to the point E, corresponding to closing of the auxiliary contact 15, represented in curve V. The point E is close to the point B, and the main contact, after a preset trip coil response time, engages its opening travel causing electrical opening at the point F. In FIG. 10, it can be seen that at the point F the inserter contacts 5 are not yet fully open mechanically and a flashover can occur on these contacts causing the shunting chamber to be destroyed. It is clear that for a response time shorter than that represented in FIG. 10, opening of the main contacts can even take place before electrical opening of the inserter contacts causing the current to be interrupted on the inserter contacts 5 which are not designed for this function. FIG. 11 represents the curves described above in the case of a control device according to the invention. The dead travel 38 shifts the closing point E of the auxiliary contact 15 and enables the main contact 2 to close mechanically before engaging the re-opening travel corresponding to the electrical tripping order. This shift ensures electrical opening of the main contact 2 after full mechanical opening of the inserter contact 5 preventing any flashover or arc formation on the latter contact. The dead travel 38 and associated high-speed closing of the contact 15 ensure that the electrical tripping order transmission is shifted accurately. It can easily be seen that the assembly is simple and allows the use of electrical contacts whose positioning is not extremely accurate.

What we claim is:

1. A control device of a high voltage electrical circuit breaker having at least one arc chute with main contacts and a parallel shunting circuit having closing resistors and inserter contacts, comprising: an articulated rod mechanism connecting the main and inserter contacts to close the inserter contacts electrically just before electrical closing of the main contacts and to reopen the inserter contacts after closing of the main contacts, a sliding control rod linking said articulated rod mechanism to a control unit, an auxiliary electrical contact mechanically actuated by the rod to represent respectively the opening and closing positions of the main contacts and an electrical transmission circuit of a circuit breaker opening order to said control unit in which electrical transmission circuit said auxiliary contact is inserted, to transmit the opening order only in the closing position of the main contacts, wherein said auxiliary contact comprises a high-speed operating mechanism having a dead travel mechanism which delays and ensures actuation of the auxiliary contact at a precise moment thereby preventing any flashover on the inserter contacts when the main contacts open subsequent to their closing.

2. A control device according to claim 1, wherein the auxiliary contact comprising a movable contact bridge fixedly attached to a rotating plate bearing an off-center pin on which a spring acts with a dead point passage to ensure said high-speed actuation.

3. A control device according to claim 2, wherein the sliding control rod bears a slide cooperating with a crank-handle to transform the sliding movement into a rotating movement transmitted to said auxiliary contact by the dead travel mechanism.

4. A control device according to claim 3, wherein said dead travel mechanism is constituted by a circular aperture arranged in a rotating plate and a pin borne by a coaxial rotating plate and moving in said aperture.

5. A control device according to claim 1, wherein the control unit and said auxiliary contact are located in an earth potential zone, the control movement being transmitted to the circuit breaker contacts by the insulating sliding rod.

6. A control device according to claim 1, wherein the time delay provided by the high-speed dead travel operating mechanism is between 10 and 30 milliseconds.

* * * * *